US008451203B2

(12) United States Patent
Kao et al.

(10) Patent No.: US 8,451,203 B2
(45) Date of Patent: May 28, 2013

(54) LIQUID CRYSTAL DISPLAY AND PIXEL ARRANGEMENT METHOD THEREOF

(75) Inventors: Ling Chih Kao, Taipei County (TW); Chia Hua Yu, Taipei County (TW); Sung Chun Lin, Tainan (TW); Kun Chen Lee, Tainan County (TW)

(73) Assignee: Hannstar Display Corp. (TW)

( * ) Notice: Subject to any disclaimer, the term of this patent is extended or adjusted under 35 U.S.C. 154(b) by 653 days.

(21) Appl. No.: 12/756,261

(22) Filed: Apr. 8, 2010

(65) Prior Publication Data

US 2010/0328277 A1 Dec. 30, 2010

(30) Foreign Application Priority Data

Jun. 30, 2009 (TW) ..... 98121997 A

(51) Int. Cl.
*G09G 3/36* (2006.01)

(52) U.S. Cl.
USPC ..... 345/92; 345/90

(58) Field of Classification Search
USPC ..... 345/92, 90
See application file for complete search history.

(56) References Cited

U.S. PATENT DOCUMENTS

| | | | | |
|---|---|---|---|---|
| 7,382,343 | B2 * | 6/2008 | Hiraki et al. | 345/96 |
| 8,035,588 | B2 * | 10/2011 | Pan et al. | 345/87 |
| 2003/0189537 | A1 | 10/2003 | Yun | |
| 2005/0046620 | A1 * | 3/2005 | Lee et al. | 345/90 |
| 2009/0096943 | A1 | 4/2009 | Uehara et al. | |
| 2011/0234556 | A1 | 9/2011 | Uehara et al. | |

FOREIGN PATENT DOCUMENTS

| | | | |
|---|---|---|---|
| CN | 101424850 | A | 5/2009 |
| TW | I269257 | B | 12/2006 |

* cited by examiner

*Primary Examiner* — Sumati Lefkowitz
*Assistant Examiner* — Duane N Taylor, Jr.
(74) *Attorney, Agent, or Firm* — Lowe Hauptman Ham & Berner, LLP

(57) ABSTRACT

A pixel arrangement method for a liquid crystal display includes the steps of: inputting data signals with different driving polarities to odd data lines and even data lines respectively; and changing connections between a gate of thin film transistor and gate lines and connections between a source of thin film transistor and data lines in every pixel area whereby the driving polarity is inverted every two pixel areas in a transverse direction and is inverted every pixel area in a longitudinal direction. The present invention further provides a liquid crystal display.

17 Claims, 6 Drawing Sheets

LIQUID CRYSTAL DISPLAY AND PIXEL ARRANGEMENT METHOD THEREOF

CROSS REFERENCE TO RELATED APPLICATION

This application claims the priority benefit of Taiwan Patent Application Serial Number 098121997, filed on Jun. 30, 2009, the full disclosure of which is incorporated herein by reference.

BACKGROUND

1. Field of the Invention

This invention generally relates to a liquid crystal display and a pixel arrangement method thereof and, more particularly, to a liquid crystal display and a pixel arrangement method thereof having low power consumption and low operation temperature.

2. Description of the Related Art

A conventional active matrix liquid crystal display includes a plurality of pixel units arranged in a matrix as shown in FIG. 1. Each pixel unit includes a thin film transistor disposed near an intersection of a data line and a gate line for driving a pixel electrode.

In order to prevent liquid crystal molecules from being driven by a DC driving voltage for a long time to cause deterioration, the art provides various driving methods to drive pixel units, e.g. a frame inversion driving method, a row inversion driving method, a column inversion driving method and a dot inversion driving method. The above mentioned driving methods drive every pixel unit of a liquid crystal display alternatively with a positive data signal and a negative data signal in successive frames.

Please refer to FIG. 2, it shows a schematic diagram of the column inversion driving method, in which in each frame a driving polarity of the data signals provided to pixels in odd columns is opposite to that provided to pixels in even columns. In this manner, the flicker between adjacent two pixels in the row direction is offset. However, since all pixels in each column are still driven by the same driving polarity in the column inversion driving method, the crosstalk between adjacent two pixels in the column direction remains as usual.

Please refer to FIG. 3, it shows a schematic diagram of the dot inversion driving method, in which in each frame a driving polarity of the data signal provided to each pixel is different from that provided to its adjacent pixels. In this manner, the flicker between adjacent two pixels is offset. However, the driver IC for the dot inversion driving has more complicated construction. As in each frame the driving polarity of data signals has to be inverted corresponding to each scan signal, this results in a higher power consumption thereby increasing the operation temperature of the driver IC.

Accordingly, it is necessary to provide a novel liquid crystal display and a pixel arrangement method thereof so as to solve the problems existed in conventional data inversion driving methods.

SUMMARY

The present invention provides a liquid crystal display and a pixel arrangement method thereof that have lower power consumption and lower operation temperature.

The present invention provides a liquid crystal display includes a pixel array. The pixel array includes a first gate line, a second gate line and a third gate line sequentially and parallelly arranged, and includes a first data line, a second data line, a third data line, a fourth data line and a fifth data line sequentially and parallelly arranged; wherein the gate lines and the data lines are perpendicular to each other. Two adjacent gate lines and two adjacent data lines define a pixel area each comprising a thin film transistor, wherein a first, a second, a third and a fourth pixel areas are sequentially defined along the first gate line, and a fifth, a sixth, a seventh and an eighth pixel areas are sequentially defined along the second gate line. A gate of the thin film transistor of the first, the second, the third, the fourth, the fifth, the sixth, the seventh and the eighth pixel areas are respectively coupled to the second, the first, the second, the first, the third, the second, the second, and the third gate lines; and a source of the thin film transistor of the first, the second, the third, the fourth, the fifth, the sixth, the seventh and the eighth pixel areas are respectively coupled to the first, the third, the fourth, the fourth, the second, the second, the third and the fifth data lines.

In the above liquid crystal display, the first, the third and the fifth data lines receive a first polarity data signal in a frame; the second and the fourth data lines receive a second polarity data signal in the same frame, wherein the first polarity is opposite to the second polarity.

The present invention further provides a liquid crystal display includes a pixel array. The pixel array includes a first gate line, a second gate line and a third gate line sequentially and parallelly arranged, and includes a first data line, a second data line, a third data line, a fourth data line and a fifth data line sequentially and parallelly arranged; wherein the gate lines and the data lines are perpendicular to each other. Two adjacent gate lines and two adjacent data lines define a pixel area each comprising a thin film transistor, wherein a first, a second, a third and a fourth pixel areas are sequentially defined along the first gate line, and a fifth, a sixth, a seventh and an eighth pixel areas are sequentially defined along the second gate line. A gate of the thin film transistor of the first, the second, the third, the fourth, the fifth, the sixth, the seventh and the eighth pixel areas are respectively coupled to the second, the first, the second, the first, the third, the second, the second, and the third gate lines; a source of the thin film transistor of the first, the second, the third, the fourth, the fifth, the sixth, the seventh and the eighth pixel areas are respectively coupled to the first, the third, the fourth, the fourth, the second, the second, the third and the fifth data lines.

In the above liquid crystal display, the first, the third and the fifth data lines receive a first polarity data signal in a frame; the second and the fourth data lines receive a second polarity data signal in the same frame, wherein the first polarity is opposite to the second polarity.

The present invention further provides a pixel arrangement of a liquid crystal display. The liquid crystal display includes a plurality of longitudinally extended data lines and a plurality of transversely extended gate lines, and two adjacent data lines and two adjacent gate lines defines a pixel area each including a thin film transistor. The pixel arrangement method includes the steps of: inputting data signals with different driving polarities to odd data lines and even data lines respectively; and changing connections between a gate of the thin film transistor and the gate lines and connections between a source of the thin film transistor and the data lines in every pixel area whereby the driving polarity is inverted every two pixel areas in a transverse direction and is inverted every pixel area in a longitudinal direction.

In the liquid crystal display of the present invention and pixel arrangement method thereof, the source driver IC is for the column inversion driving rather than the dot inversion driving. By using a driver IC for the column inversion driving, the driving process may be simplified and the power consumption and operation temperature of the driver IC during operation may also be reduced.

BRIEF DESCRIPTION OF THE DRAWINGS

Other objects, advantages, and novel features of the present invention will become more apparent from the following detailed description when taken in conjunction with the accompanying drawings.

DETAILED DESCRIPTION OF THE EMBODIMENT

It should be noticed that, wherever possible, the same reference numbers will be used throughout the drawings to refer to the same or like parts.

Figure 1:
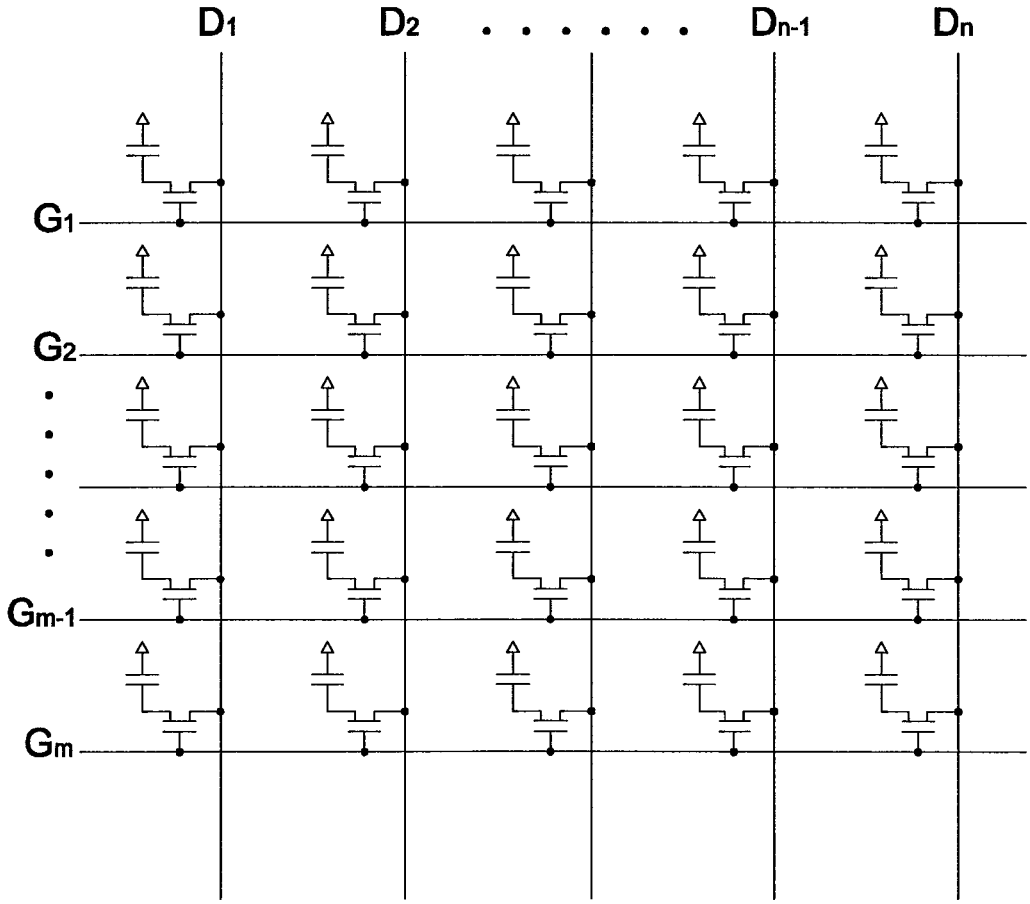
FIG. 1(PRIOR ART)
FIG. 1 shows a schematic diagram of the pixel arrangement of a conventional liquid crystal display.
Figure 2:
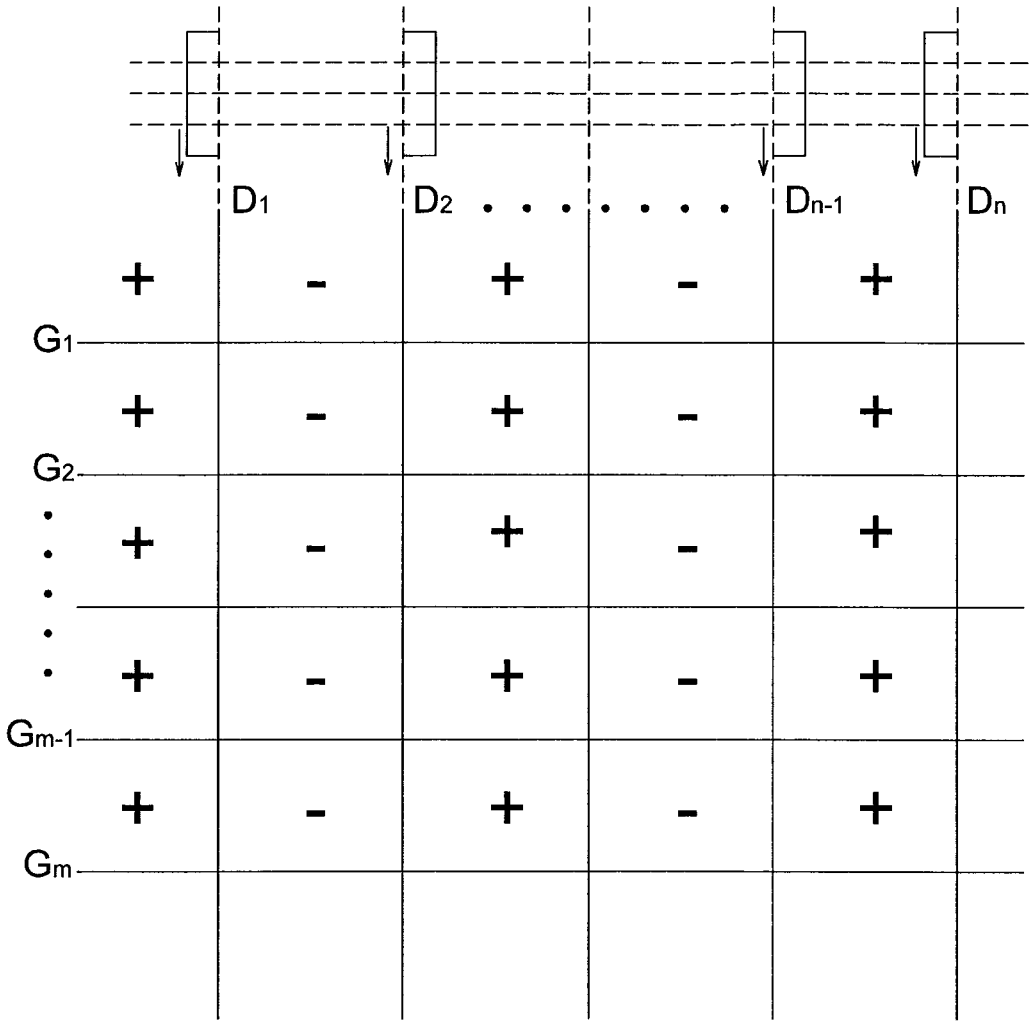
FIG. 2 shows a schematic diagram of the column inversion driving method.
Figure 3:
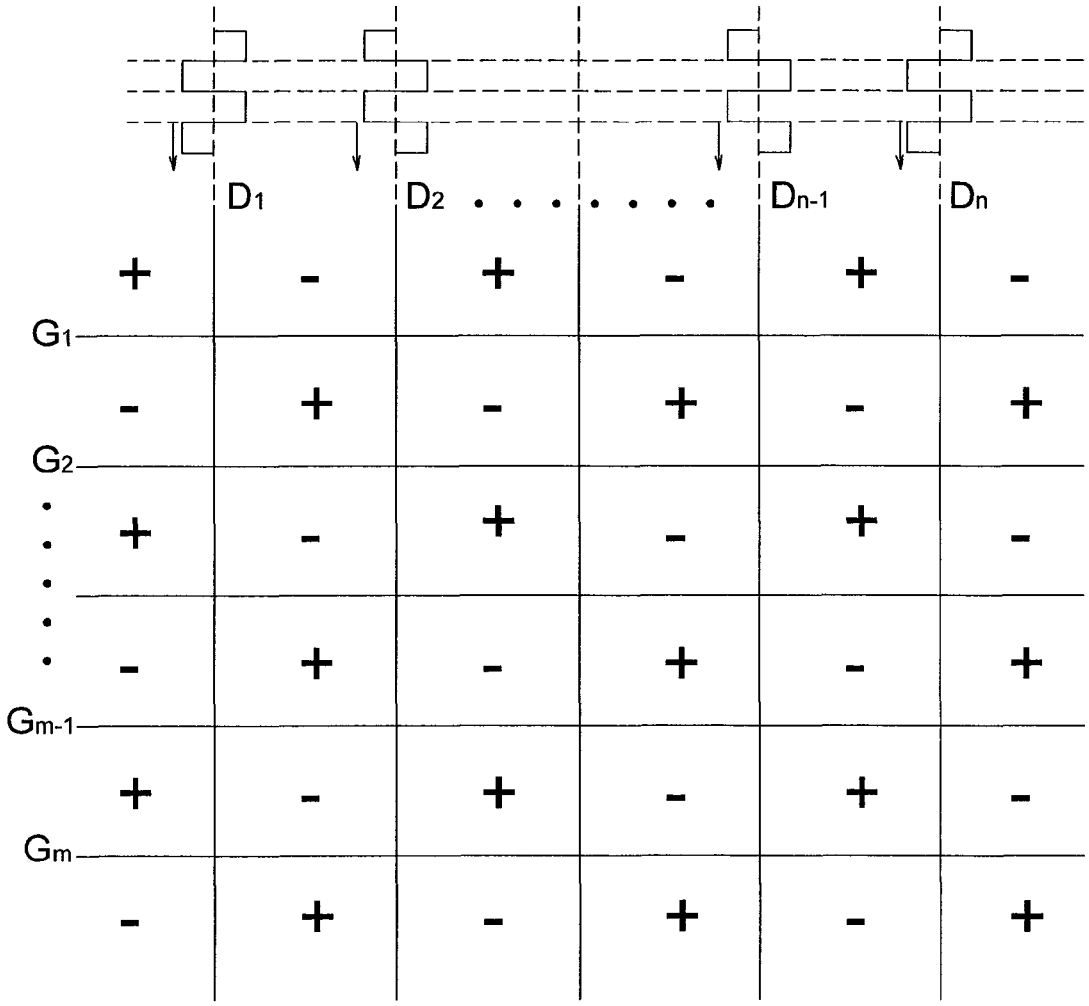
FIG. 3 shows a schematic diagram of the dot inversion driving method.
Figure 4:
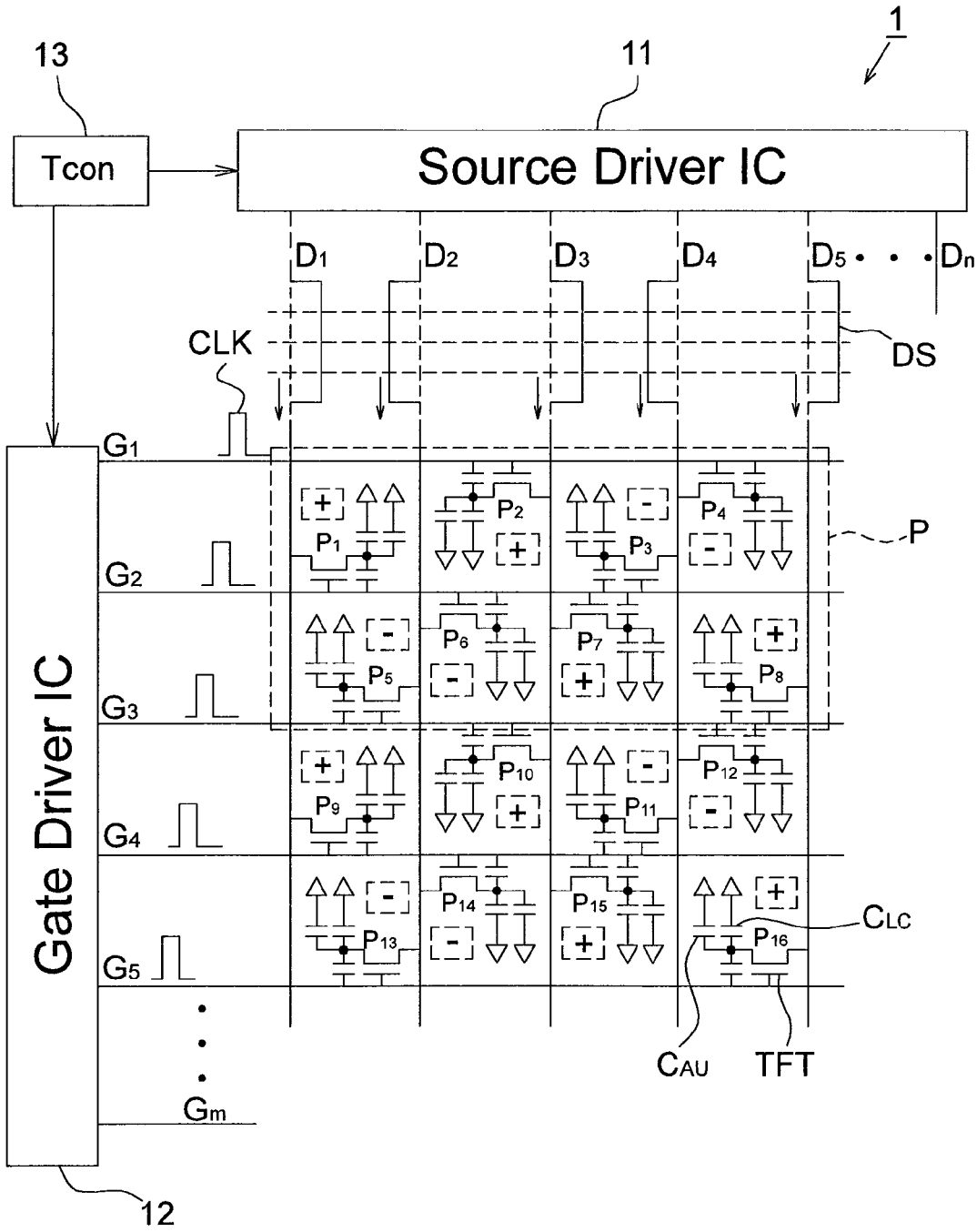
FIG. 4 shows a schematic diagram of the liquid crystal display in accordance with an embodiment of the present invention.
Figure 5:
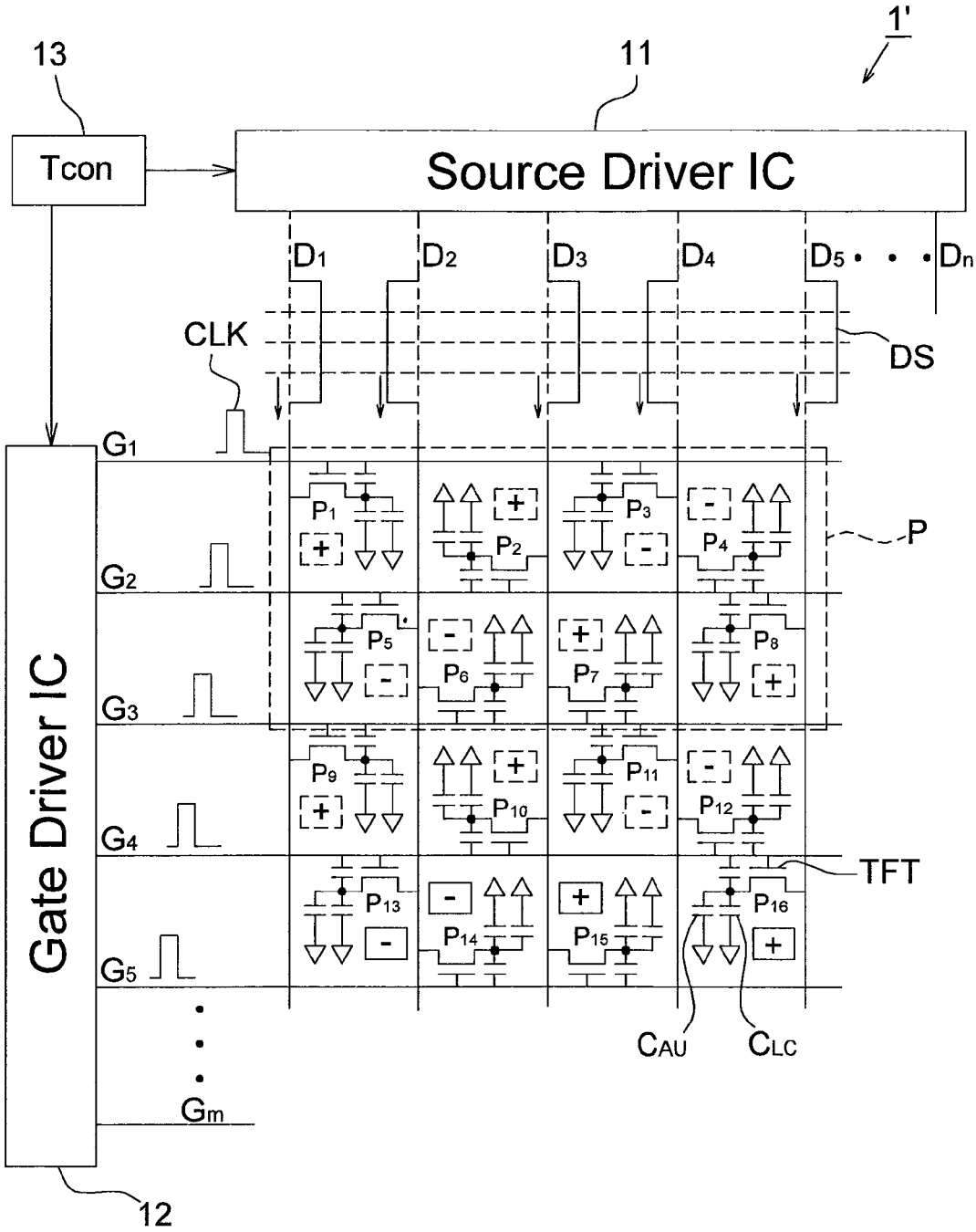
FIG. 5 shows a schematic diagram of the liquid crystal display in accordance with another embodiment of the present invention.

Please refer to FIGS. 4 and 5, they respectively show a schematic diagram of the liquid crystal display in accordance with an embodiment of the present invention. The liquid crystal display 1 and 1' include a plurality of parallel data lines $D_1$~$D_n$, a plurality of parallel gate lines $G_1$~$G_m$, a source driver IC 11, a gate driver IC 12 and a time controller 13, wherein the time controller 13 is coupled to the source driver IC 11 and the gate, driver IC 12 for controlling the source driver IC 11 to output data signals DS to the data lines $D_1$~$D_n$ in a frame and controlling the gate driver IC 12 to output a scan signal CLK to the gate lines $G_1$~$G_m$ in the same frame. The data lines $D_1$~$D_n$, and the gate lines $G_1$~$G_m$ together form a pixel array, which is formed by a plurality of pixel repeating groups P sequentially arranged along a transverse direction and a longitudinal direction. It is appreciated that the liquid crystal display 1 and 1' only show the components for illustrating the present invention and omit other components.

The gate lines $G_1$~$G_m$, cross the data lines $D_1$~$D_n$, and two adjacent gate lines and two adjacent data lines together define a pixel area, e.g. the gate lines $G_1$, $G_2$ and the data line $D_1$, $D_2$ together define a pixel area $P_1$, the gate lines $G_1$, $G_2$ and the data line $D_2$, $D_3$ together define a pixel area $P_2$, and so on. Each pixel area includes a thin film transistor TFT, a liquid crystal capacitor $C_{LC}$ and an auxiliary capacitor $C_{AU}$. A gate of the thin film transistor TFT is coupled to one of the two gate lines defining the corresponding pixel area; a source of the thin film transistor TFT is coupled to one of the two data lines defining the same pixel area; and a drain of the thin film transistor TFT is coupled to the liquid crystal capacitor $C_{LC}$ and the auxiliary capacitor $C_{AU}$ of the same pixel area.

Please refer to FIG. 4 again, in an embodiment, a pixel repeating group P includes transversely extended first gate line $G_1$, second gate line $G_2$ and third gate line $G_3$ to be arranged parallelly and sequentially along a longitudinal direction, e.g. from up to down. The pixel repeating group P also includes longitudinally extended first data line $D_1$, second data line $D_2$, third data line $D_3$, fourth data line $D_4$ and fifth data line $D_5$ to be arranged parallelly and sequentially along a transverse direction, e.g. from left to right. Two adjacent data lines and two adjacent gate lines define a pixel area, and a pixel repeating group P is divided into 2×4 pixel areas by the gate lines (e.g. $G_1$~$G_3$) and the data lines (e.g. $D_1$~$D_5$).

For example in FIG. 4, in the pixel repeating group P the first row of pixel areas along the first gate line $G_1$ (i.e. a transverse direction) are sequentially defined as a first pixel area $P_1$, a second pixel area $P_2$, a third pixel areas $P_3$ and a fourth pixel area $P_4$; the second row of pixel areas in the pixel repeating group P along the second gate line $G_2$ (i.e. the transverse direction) are sequentially defined as a fifth pixel area $P_5$, a sixth pixel area $P_6$, a seventh pixel areas $P_7$ and an eighth pixel area $P_8$, wherein each pixel area $P_1$~$P_8$ includes a thin film transistor TFT, a liquid crystal capacitor $C_{LC}$ and an auxiliary capacitor $C_{AU}$, and a drain of the thin film transistor TFT is coupled to the liquid crystal capacitor $C_{LC}$ and the auxiliary capacitor $C_{AU}$. Herein, the transverse direction is defined as the left-and-right direction while the longitudinal direction is defined as the up-and-down direction.

In the pixel repeating group P, a gate of the thin film transistor TFT of the first pixel area $P_1$ is coupled to the second gate line $G_2$, and a source thereof is coupled to the first data line $D_1$. A gate of the thin film transistor TFT of the second pixel area $P_2$ is coupled to the first gate line $G_1$, and a source thereof is coupled to the third data line $D_3$. A gate of the thin film transistor TFT of the third pixel area $P_3$ is coupled to the second gate line $G_2$, and a source thereof is coupled to the fourth data line $D_4$. A gate of the thin film transistor TFT of the fourth pixel area $P_4$ is coupled to the first gate line $G_1$, and a source thereof is coupled to the fourth data line $D_4$. A gate of the thin film transistor TFT of the fifth pixel area $P_5$ is coupled to the third gate line $G_3$, and a source thereof is coupled to the second data line $D_2$. A gate of the thin film transistor TFT of the sixth pixel area $P_6$ is coupled to the second gate line $G_2$, and a source thereof is coupled to the second data line $D_2$. A gate of the thin film transistor TFT of the seventh pixel area $P_7$ is coupled to the second gate line $G_2$, and a source thereof is coupled to the third data line $D_3$. A gate of the thin film transistor TFT of the eighth pixel area $P_8$ is coupled to the third gate line $G_3$, and a source thereof is coupled to the fifth data line $D_5$.

During operation, the time controller 13 controls the source driver IC, which is the driver IC for the column inversion driving, to send data signals DS to the data lines $D_1$~$D_5$ in a frame, i.e. providing a first polarity data signal to the first data line $D_1$, the third data line $D_3$ and the fifth data line $D_5$ (i.e. odd columns of the data lines) whereas providing a second polarity data signal to the second data line $D_2$ and the fourth data line $D_4$ (i.e. even columns of the data lines), wherein the polarity of the first polarity data signal is opposite to that of the second polarity data signal. The time controller 13 also controls the gate driver IC 12 to sequentially provide a scan signal CLK to the gate lines $G_1$~$G_3$ in the same frame. The frame herein refers to a period that the gate driver IC 12 sequentially provides the scan signal CKL to all gate lines $G_1$~$G_m$, once. Accordingly, although the source driver IC 11 performs column inversion driving, a 2H1V driving may be implemented in a pixel array, i.e. the driving polarity of data signals is inverted every two pixel areas in a horizontal direction and is inverted every pixel area in a vertical direction.

Therefore, in this embodiment, since the source driver IC 11 needs not to invert the driving polarity of data signals corresponding to every scan signal CLK, it is able to reduce the power consumption, simplify the construction and further reduce the operation temperature of the source driver IC 11 significantly.

Please refer to FIG. 5 again, it shows the liquid crystal display according to another embodiment of the present invention. Differences between FIG. 5 and FIG. 4 are in that, the connections between the gate of the thin film transistors TFT and the gate lines and the connections between the source of the thin film transistors TFT and the data lines of the pixel areas in the pixel repeating group P shown in FIG. 5 are different to those shown in FIG. 4. For example in this embodiment, a gate of the thin film transistor TFT of the first pixel area $P_1$ is coupled to the first gate line $G_1$, and a source thereof is coupled to the first data line $D_1$. A gate of the thin film transistor TFT of the second pixel area $P_2$ is coupled to the second gate line $G_2$, and a source thereof is coupled to the third data line $D_3$. A gate of the thin film transistor TFT of the third pixel area $P_3$ is coupled to the first gate line $G_1$, and a source thereof is coupled to the fourth data line $D_4$. A gate of the thin film transistor TFT of the fourth pixel area $P_4$ is coupled to the second gate line $G_2$, and a source thereof is coupled to the fourth data line $D_4$. A gate of the thin film transistor TFT of the fifth pixel area $P_5$ is coupled to the second gate line $G_2$, and a source thereof is coupled to the second data line $D_2$. A gate of the thin film transistor TFT of the sixth pixel area $P_6$ is coupled to the third gate line $G_3$, and a source thereof is coupled to the second data line $D_2$. A gate of the thin film transistor TFT of the seventh pixel area $P_7$ is coupled to the third gate line $G_3$, and a source thereof is coupled to the third data line $D_3$. A gate of the thin film transistor TFT of the eighth pixel area $P_8$ is coupled to the second gate line $G_2$, and a source thereof is coupled to the fifth data line $D_5$.

Figure 6:
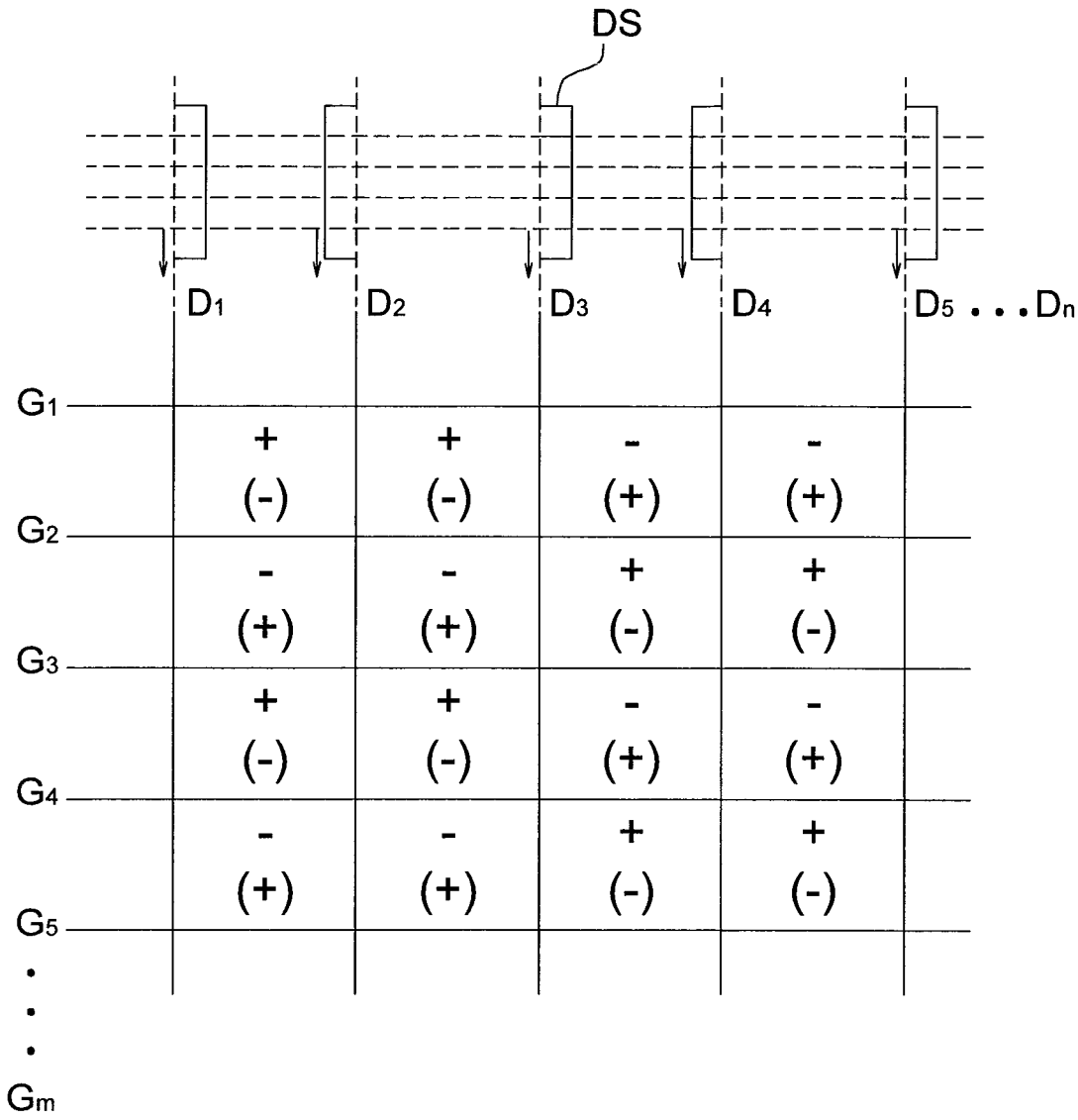
FIG. 6 shows a schematic diagram of the pixel arrangement method of a liquid crystal display in accordance with an embodiment of the present invention.

Please refer to FIG. 6, it shows a schematic diagram of the pixel arrangement method of a liquid crystal display according to the embodiment of the present invention. The pixel arrangement method includes the steps of: inputting data signals with different driving polarities to odd data lines and even data lines respectively; and changing connections between a gate of the thin film transistor and the gate lines and connections between a source of the thin film transistor and the data lines in every pixel area whereby the driving polarity is inverted every two pixel areas in a transverse direction and inverted every pixel area in a longitudinal direction. Details of the pixel arrangement method have been illustrated in FIGS. 4, 5 and their corresponding illustrations and thus details will not be repeated herein.

In a word, in order to solve the problem of the dot inversion driving method, i.e. high power consumption and high operation temperature of the source driver IC, the source driver IC of the present invention outputs column inversion data signals to the data lines $D_1$~$D_n$ and is able to implement a 2H1V inversion driving by changing the connections between the gate of the thin film transistor and the gate lines and the connections between the source of the thin film transistor and the data lines in every pixel area, i.e. the driving polarity is inverted every two pixel areas in a horizontal direction (i.e. along the gate line direction) and is inverted every pixel area in a vertical direction (i.e. along the data line direction). In this manner, the construction of the source driver IC may be simplified and the power consumption and operation temperature thereof may also be reduced.

As mentioned above, the source driver IC employed in the conventional dot inversion driving method has more complicated structure and consumes more power, and thus the operation temperature of the driver IC will be increased. The present invention provides a liquid crystal display and a pixel arrangement method thereof (FIGS. 5 and 6) that may embody a 2H1V driving with a column inversion driving so as to reduce the power consumption and operation temperature of the driver IC.

Although the invention has been explained in relation to its preferred embodiment, it is not used to limit the invention. It is to be understood that many other possible modifications and variations can be made by those skilled in the art without departing from the spirit and scope of the invention as hereinafter claimed.

What is claimed is:

1. A liquid crystal display, comprising a pixel array, the pixel array comprising:

a first gate line, a second gate line and a third gate line sequentially and parallelly arranged;

a first data line, a second data line, a third data line, a fourth data line and a fifth data line sequentially and parallelly arranged;

wherein the gate lines and the data lines are perpendicular to each other;

wherein two adjacent gate lines and two adjacent data lines define a pixel area each comprising a thin film transistor;

wherein a first, a second, a third and a fourth pixel areas are sequentially defined along the first gate line, and a fifth, a sixth, a seventh and an eighth pixel areas are sequentially defined along the second gate line;

wherein a gate of the thin film transistor of the first, the second, the third, the fourth, the fifth, the sixth, the seventh and the eighth pixel areas are respectively coupled to the second, the first, the second, the first, the third, the second, the second and the third gate lines; a source of the thin film transistor of the first, the second, the third, the fourth, the fifth, the sixth, the seventh and the eighth pixel areas are respectively coupled to the first, the third, the fourth, the fourth, the second, the second, the third and the fifth data lines.

2. The liquid crystal display as claimed in claim 1, wherein the first, the third and the fifth data lines receive a first polarity data signal in a frame; the second and the fourth data lines receive a second polarity data signal in the frame; and the first polarity is opposite to the second polarity.

3. The liquid crystal display as claimed in claim 2, wherein the first, the second and the third gate lines sequentially receive a scan signal in the frame.

4. The liquid crystal display as claimed in claim 3, wherein the liquid crystal display further comprises a gate driver IC configured to provide the scan signal.

5. The liquid crystal display as claimed in claim 2, wherein the liquid crystal display further comprises a source driver IC configured to provide the first polarity data signal and the second polarity data signal.

6. The liquid crystal display as claimed in claim 5, wherein the source driver IC is for the column inversion driving and configured to generate the first polarity data signal and the second polarity data signal.

7. The liquid crystal display as claimed in claim 1, wherein each pixel area further comprises a liquid crystal capacitor and an auxiliary capacitor coupled to a drain of the thin film transistor.

8. A liquid crystal display, comprising a pixel array, the pixel array comprising:

a first gate line, a second gate line and a third gate line sequentially and parallelly arranged;

a first data line, a second data line, a third data line, a fourth data line and a fifth data line sequentially and parallelly arranged;

wherein the gate lines and the data lines are perpendicular to each other;

wherein two adjacent gate lines and two adjacent data lines define a pixel area each comprising a thin film transistor;

wherein a first, a second, a third and a fourth pixel areas are sequentially defined along the first gate line, and a fifth, a sixth, a seventh and an eighth pixel areas are sequentially defined along the second gate line;

wherein a gate of the thin film transistor of the first, the second, the third, the fourth, the fifth, the sixth, the seventh and the eighth pixel areas are respectively coupled to the first, the second, the first, the second, the second, the third, the third and the second gate lines; a source of the thin film transistor of the first, the second, the third, the fourth, the fifth, the sixth, the seventh and the eighth pixel areas are respectively coupled to the first, the third, the fourth, the fourth, the second, the second, the third and the fifth data lines.

9. The liquid crystal display as claimed in claim 8, wherein the first, the third and the fifth data lines receive a first polarity data signal in a frame; the second and the fourth data lines receive a second polarity data signal in the frame; and the first polarity is opposite to the second polarity.

10. The liquid crystal display as claimed in claim 9, wherein the first, the second and the third gate lines sequentially receive a scan signal in the frame.

11. The liquid crystal display as claimed in claim 10, wherein the liquid crystal display further comprises a gate driver IC configured to provide the scan signal.

12. The liquid crystal display as claimed in claim 9, wherein the liquid crystal display further comprises a source driver IC configured to provide the first polarity data signal and the second polarity data signal.

13. The liquid crystal display as claimed in claim 12, wherein the source driver IC is for the column inversion driving and configured to generate the first polarity data signal and the second polarity data signal.

14. The liquid crystal display as claimed in claim 8, wherein each pixel area further comprises a liquid crystal capacitor and an auxiliary capacitor coupled to a drain of the thin film transistor.

15. A pixel arrangement method of a liquid crystal display, the liquid crystal display comprising a plurality of longitudinally extended data lines and a plurality of transversely extended gate lines, two adjacent data lines and two adjacent gate lines defining a pixel area each comprising a thin film transistor, the pixel arrangement method comprising the steps of:

inputting data signals with different driving polarities to odd data lines and even data lines respectively; and changing connections between a gate of the thin film transistor and the gate lines and connections between a source of the thin film transistor and the data lines in every pixel area whereby the driving polarity is inverted every two pixel areas in a transverse direction and inverted every pixel area in a longitudinal direction.

16. The pixel arrangement method as claimed in claim 15, further comprising the step of: sequentially inputting a scan signal from the gate lines.

17. The pixel arrangement method as claimed in claim 15, further comprising the step of: providing a driver IC for the column inversion driving to generate the data signals with different driving polarities.

* * * * *